US006351111B1

(12) United States Patent
Laraia

(10) Patent No.: US 6,351,111 B1
(45) Date of Patent: Feb. 26, 2002

(54) CIRCUITS AND METHODS FOR PROVIDING A CURRENT REFERENCE WITH A CONTROLLED TEMPERATURE COEFFICIENT USING A SERIES COMPOSITE RESISTOR

(75) Inventor: J. Marcos Laraia, Pocatello, ID (US)

(73) Assignee: AMI Semiconductor, Inc., Pocatello, ID (US)

( * ) Notice: Subject to any disclaimer, the term of this patent is extended or adjusted under 35 U.S.C. 154(b) by 0 days.

(21) Appl. No.: 09/834,421

(22) Filed: Apr. 13, 2001

(51) Int. Cl.[7] ..... G05F 3/26
(52) U.S. Cl. ..... 323/315; 323/907; 327/538
(58) Field of Search ..... 323/312, 313, 323/314, 315, 317, 907; 327/512, 513, 538, 540, 541, 542, 543

(56) References Cited

U.S. PATENT DOCUMENTS

| | | | | | |
|---|---|---|---|---|---|
| 4,342,926 | A | | 8/1982 | Whatley | 307/297 |
| 4,450,367 | A | | 5/1984 | Whatley | 307/297 |
| 4,461,991 | A | | 7/1984 | Smith | 323/312 |
| 4,792,748 | A | * | 12/1988 | Thomas et al. | 323/312 |
| 4,890,052 | A | | 12/1989 | Hellums | 323/315 |
| 4,935,690 | A | | 6/1990 | Yan | 323/314 |
| 5,144,223 | A | | 9/1992 | Gillingham | 323/313 |
| 5,155,384 | A | | 10/1992 | Ruetz | 307/296.8 |
| 5,432,432 | A | | 7/1995 | Kimura | 323/313 |
| 5,635,869 | A | * | 6/1997 | Ferraiolo et al. | 327/543 |
| 5,828,329 | A | * | 10/1998 | Burns | 341/155 |
| 5,859,560 | A | | 1/1999 | Matthews | 327/513 |
| 5,889,394 | A | | 3/1999 | Czarnocki | 323/313 |
| 5,910,749 | A | * | 6/1999 | Kimura | 327/541 |
| 5,990,727 | A | * | 11/1999 | Kimura | 327/513 |
| 6,028,472 | A | * | 2/2000 | Nagumo | 327/512 |
| 6,087,820 | A | | 7/2000 | Houghton et al. | 323/315 |
| 6,150,871 | A | * | 11/2000 | Yee | 327/538 |

* cited by examiner

*Primary Examiner*—Adolf Deneke Berhane
(74) *Attorney, Agent, or Firm*—Workman, Nydegger & Seeley

(57) ABSTRACT

A current reference circuit provides a reference current that has a controlled temperature coefficient and is relatively stable with supply voltage fluctuations. The reference leg includes a series of MOS transistors including at least one PMOS transistor that is electrically closer in the series to a high voltage source, at least one NMOS transistor that is electrically closer in the series to the low voltage source. The series composite resistor comprises at least two resistors coupled in series within the current path. The size of the resistors may be designed so as to lower the temperature dependency of the circuit. A bipolar transistor is also coupled in the reference leg. The mirror leg is similar to the reference leg except that no series resistor is provided, and the emitter area of the bipolar resistor in the reference leg is larger than the emitter area of the bipolar transistor in the mirror leg.

39 Claims, 5 Drawing Sheets

CIRCUITS AND METHODS FOR PROVIDING A CURRENT REFERENCE WITH A CONTROLLED TEMPERATURE COEFFICIENT USING A SERIES COMPOSITE RESISTOR

CROSS-REFERENCE TO RELATED APPLICATIONS

The present application is related to commonly-owned co-pending application serial number entitled "CIRCUITS AND METHODS FOR PROVIDING A BANDGAP VOLTAGE REFERENCE USING COMPOSITE RESISTORS" filed on the same date herewith, which application is incorporated herein by reference in its entirety.

THE FIELD OF THE INVENTION

The present invention relates to the field of current reference circuits. In particular, the present invention relates to circuits and methods for providing a current reference with a controlled temperature coefficient using a series composite resistor.

BACKGROUND AND RELATED ART

Current reference circuits are used in many CMOS integrated circuits. The purpose of a current reference circuit is to provide a reference current that may be mirrored into other parts of the circuit. The reference current does fluctuate to a certain extent. Such fluctuations are acceptable in some applications, but not in others. Potential causes of reference current fluctuations are operating temperature changes and supply voltage fluctuations.

FIG. 4 illustrates a conventional current reference circuit 400 that provides a relatively stable reference current despite fluctuations in operating temperature and supply voltage. The circuit 400 includes a positive rail $V_{DD}$ and a negative rail $V_{SS}$. A start up circuit (represented by all the circuitry above brackets 401) includes PMOS transistors 4M1, 4M2, and 4M3 as well as capacitor 402 configured as shown in FIG. 4. The circuitry other than the startup circuit 401 has two stable states upon startup, one that provides a reference current, and one that does not. The startup circuit 401 ensures that the remaining current reference circuitry assumes the stable state that results in a reference current.

Excluding the startup circuit 401, the circuit 400 includes two potential current paths between the positive rail $V_{DD}$ and the negative rail $V_{SS}$. One current path called a "reference leg" is identified as the circuitry above brackets 403. The current path through the reference leg 403 is through the channel regions of diode-connected PMOS transistors 423 and 427, the channel regions of NMOS transistors 431 and 435, the resistor 439 and the bipolar transistor 441. The other current path called the "mirror leg" is identified as the circuitry above brackets 404. The current path through the mirror leg 404 is through the channel regions of PMOS transistors 421 and 425, the channel regions of diode-connected NMOS transistors 429 and 433, and the bipolar transistor 437. The total emitter area of the bipolar transistor 441 is greater than the total emitter area of the bipolar transistor 437.

Accordingly, the circuit 400 provides a current along the current path of the reference leg 403 that is relatively insensitive to supply voltage fluctuations. However, due to the temperature sensitivity of the bipolar transistors 437 and 441, the voltage applied across the resistor 439 is largely proportional to absolute temperature. The current in the reference leg 403 may be mirrored into other parts of the circuit (not shown) as needed.

The circuit 400 is similar to early conventional CMOS current reference circuits, except that some conventional current reference circuits use only one PMOS transistor and/or only one NMOS transistor in each leg. However, devices that use more than one PMOS transistor and/or more than one NMOS transistor (called "cascoded" devices) reduce the dependency between supply voltage and reference current. Accordingly, cascoded devices provide more stable reference currents.

Another key difference is that in conventional current reference currents, the resistor 439 generally does not have a resistance that compensates for the voltage applied across the resistor being roughly proportional to absolute temperature. Thus, the current reference provided by conventional current reference circuits varies significantly with temperature. In contrast, the circuit 400 reduces the temperature dependency of conventional current reference circuits by providing resistor 439 as a polysilicon resistor which is custom doped so that the resistor 439 (and the corresponding reference leg) has current flowing therethrough during operation that is less dependent upon temperature within a given operating temperature range.

Therefore, the circuit 400 improves upon the prior state of the art by providing a reference current that is less dependent on supply voltage and temperature fluctuations. However, the circuit 400 also requires custom doping which generally introduces manufacturing inefficiencies.

FIG. 5 illustrates another conventional temperature compensated current reference circuit 500. The circuit 500 provides current references that are also stable with temperature and supply voltage fluctuations. However, the circuit 500 does not require the custom doping that is required by the circuit 400.

The circuit 500 is similar to the circuit 400 except that the circuit 500 is not cascoded. In addition, the circuit 500 includes a parallel composite resistor that includes resistor 556 and resistor 558 situated in parallel within the current flow of the reference leg. Standard processing steps may be used to form each of the parallel resistors. By having one resistor be manufactured by process steps that result in a temperature coefficient below a target temperature coefficient, and the other resistor be manufactured by process steps that results in a temperature coefficient above the target temperature coefficient, the sizes of each parallel resistor can be designed so that the parallel composite resistor generally achieves the target temperature coefficient. Thus, the circuit 500 allows for accurate temperature compensation in which the resistors may be formed by standard processes.

Parallel resistors tend to be quite large in order to provide a composite resistor having a given resistance. Accordingly, the parallel composite resistor occupies significant valuable chip space. Therefore, what is desired are circuits and methods for providing a reference current that has a controlled temperature coefficient, which is relatively stable with supply voltage fluctuations, which does not require custom doping, and which efficiently uses chip space.

SUMMARY OF THE INVENTION

In accordance with the present invention, circuits and methods for providing a reference current are described. A current reference circuit has a reference leg and a mirror leg configured such that the current in the reference leg is mirrored in the mirror leg and such that a reference current is generated in the reference leg, the reference current being relatively stable with supply voltage and temperature fluctuations. A series composite resistor is disposed in the reference leg. The series composite resistor minimizes space as compared to using a parallel composite resistor. In addition, custom doping is not required to fabricate the series composite resistor.

The current reference circuit is coupled to a high voltage source that is configured to supply a relatively high voltage during operation. In addition, the current reference circuit is coupled to a low voltage source that is configured to supply a relatively low voltage during operation. The current reference circuit defines two current paths between the high voltage source and the low voltage source, one current path being through a reference leg, and the other current path being through a mirror leg.

The reference leg includes a series of MOS transistors including at least one PMOS transistor that is electrically closer in the series to the high voltage source. In addition, the MOS transistors also include at least one NMOS transistor that is electrically closer in the series to the low voltage source.

The reference leg also includes a series composite resistor comprising at least two resistors coupled in series within the current path. The series composite resistor is disposed on either side of the plurality of MOS transistors in series between the high and low voltage sources. The resistors in the series composite resistor may be fabricated by different processing steps. Custom doping need not be employed in fabricating the resistors.

Each resistor in the series composite resistor has its own temperature coefficient. The size of each resistor in the series composite resistor may be designed such that the temperature coefficient of the series composite resistor closely matches the temperature coefficient of the reference current. Thus, the resulting reference current circuit may generate a reference current that is relatively stable with temperature fluctuations. In addition, the series composite resistor may be relatively small compared to a parallel composite resistor for a given resistance.

The reference leg also includes a forward region bipolar transistor coupled in series between the high and low voltage sources. A "forward region" bipolar transistor is defined for purposes of this description and in the claims to be a bipolar transistor that has its emitter-base PN junction forward biased and its collector-base PN junction off during operation. The forward region bipolar transistor is disposed between the series composite resistor and a given voltage source that is either the high or low voltage source.

The mirror leg includes another series of MOS transistors that include at least one PMOS transistor that is electronically closer in the series to the high voltage source. At least one of the PMOS transistors shares a common gate terminal with a PMOS transistor in the reference leg. The MOS transistors also include at least one NMOS transistor that is electronically closer in the series to the low voltage source. At least one of the NMOS transistors shares a common gate terminal with an NMOS transistor in the reference leg.

The mirror leg also includes a forward region bipolar transistor having the same polarity as the bipolar transistor in the reference leg. The forward region bipolar transistor in the mirror leg is disposed between the MOS transistors and the given voltage source. The emitter area of the bipolar transistor in the reference leg is larger than the emitter area of the bipolar transistor in the mirror leg, thereby allowing for a current to flow through the series composite resistors.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present invention extends to both circuits and methods for providing a current reference that has a controlled temperature coefficient with supply voltage fluctuations. In accordance with the present invention, a current reference circuit has a high voltage rail and a low voltage rail. A reference leg and a mirror leg are each coupled between the high and low voltage rails to define two potential current paths from the high voltage rail to the low voltage rail. The reference leg is coupled to the mirror leg such that the current through the reference leg is mirrored in the mirror leg.

The reference leg includes a number of MOS transistors that are coupled in series between the high and low voltage rails. The MOS transistors include a group of one or more PMOS transistors that are electrically closer in the series to the high voltage source. Also, the MOS transistors include a group of one or more NMOS transistors that are electrically closer in the series to the low voltage source. The reference leg also includes a series composite resistor that is disposed on either side of the MOS transistors. The series composite resistor includes a first resistor and a second resistor that are connected in series between the high and low voltage rails. As will be described in further detail below, this current reference circuit supplies a reference current that has a controlled temperature coefficient and is relatively stable with supply voltage fluctuations.

Although specific circuits are described herein, those skilled in the art will recognize, given the teaching of this description, that various modifications and additions may also be made that will implement the principles of the present invention. It is intended that the present invention embrace all such modifications and additions.

In this description, the structure of an example current reference circuit in accordance with the present invention will be described with respect to FIG. 1 and FIG. 2. Then, the operation of the circuit of FIG. 1 will be described along with the advantages obtained by such a circuit. In conclusion, an alternative configuration of a reference circuit will be described with respect to FIG. 3.

Figure 1:
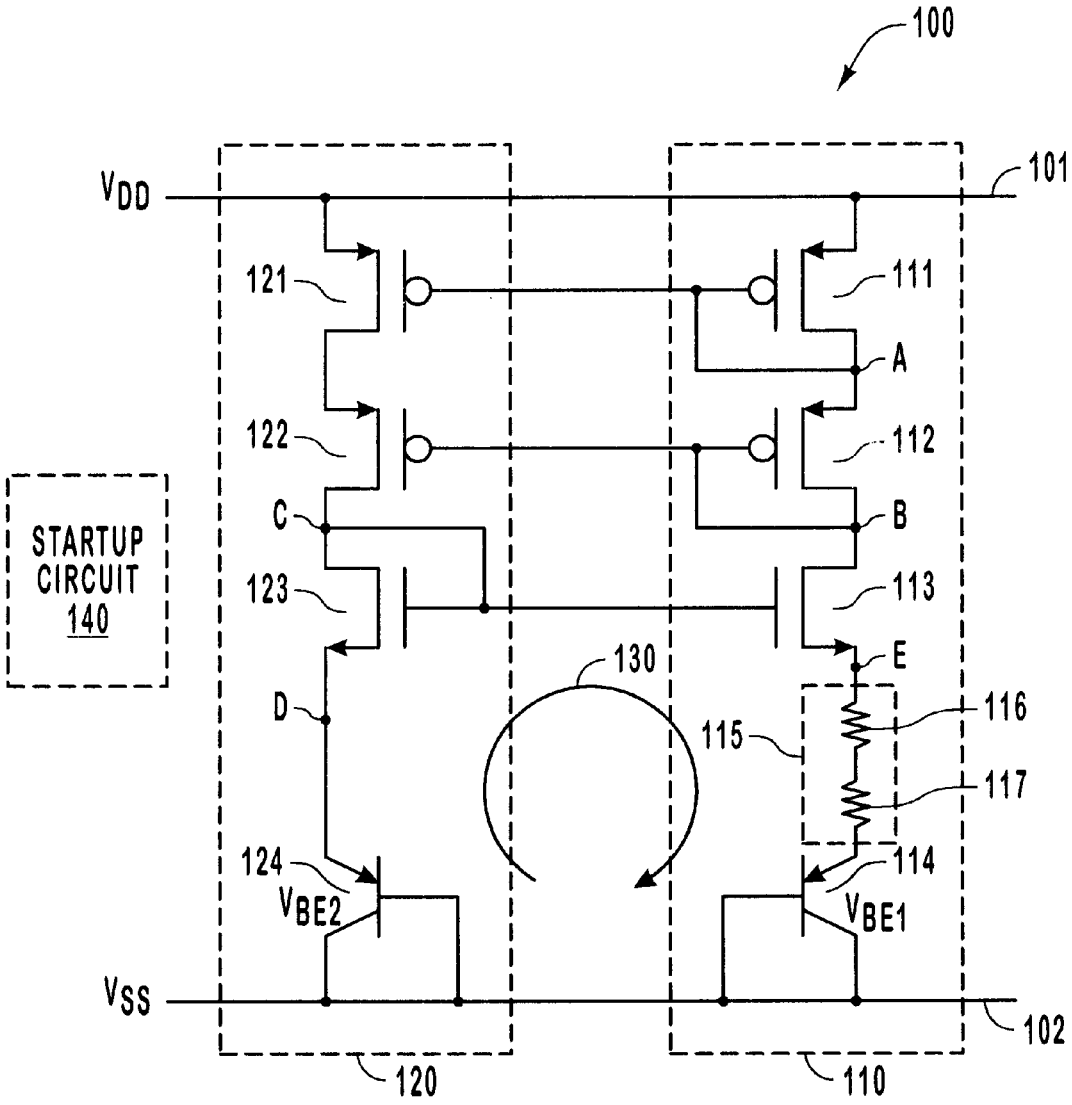
FIG. 1 illustrates a current reference circuit that uses a series composite resistor in accordance with the present invention.

FIG. 1 illustrates a current reference circuit 100 in accordance with the present invention. The current reference circuit 100 includes voltage sources 101 and 102, which may be, for example, voltage rails. The voltage source 101 is configured, during operation, to carry a higher voltage that the voltage source 102. Accordingly, voltage source 101 will often be referred to as "high" voltage source 101, while voltage source 102 will often be referred to as "low" voltage source 102. For example, during operation, voltage source 101 carries a voltage $V_{DD}$ while voltage source 102 carries a voltage $V_{SS}$ (e.g., ground). As will be explained herein, the current reference circuit provides a reference current that has a controlled temperature coefficient and is relatively stable with fluctuations in $V_{DD}$.

The current reference circuit 100 includes two potential current paths between the high voltage source 101 and the low voltage source 102. The two potential current paths are symbolically encased by dashed boxes in FIG. 1. The dashed box 110 encases a current path that will be referred to as the reference leg (also referred to as "reference leg 110"). The dashed box 120 encases a current path that will be referred to as the mirror leg (also referred to as "mirror leg 120").

The reference leg 110 includes a number of MOS transistors that are coupled in series between the high voltage source 101 and the low voltage source 102. For example, the reference leg 110 includes MOS transistors 111, 112, and 113. The MOS transistors include at least one PMOS transistor and at least one NMOS transistor. For example, the reference leg 110 includes two PMOS transistors 111 and 112 and one NMOS transistor 113.

The one or more PMOS transistors are electronically closer in the series to the high voltage source 101 as compared to the one or more NMOS transistors. For example, PMOS transistors 111 and 112 are electrically closer in the series to the high voltage source 101 as compared to the NMOS transistor 113.

The mirror leg 120 also includes a number of MOS transistors that are coupled in series between the high voltage source 101 and the low voltage source 102. For example, the mirror leg 120 includes MOS transistors 121, 122, and 123. The MOS transistors include at least one PMOS transistor and at least one NMOS transistor. However, the mirror leg should include MOS transistors that match the configuration of the MOS transistors in the reference leg. For example, the mirror leg 120 includes two PMOS transistors 121 and 122 and one NMOS transistor 123 in which the PMOS transistors are electronically closer to the high voltage source 101 than the NMOS transistor. The position of the MOS transistors 121, 122 and 123 in the mirror leg 120 correspond generally to the position of the MOS transistors 111, 112 and 113 in the reference leg.

The MOS transistors are configured such that the PMOS transistors 111, 112, 121 and 122 act to mirror the currents through the reference leg 110 and the mirror leg 120. If the PMOS transistors are enhancement type, this may be accomplished by coupling the gate of PMOS transistor 111 to its drain, coupling the gate of PMOS transistor 112 to its drain, sharing the gate terminal between PMOS transistors 111 and 121, and sharing the gate terminal between PMOS transistors 112 and 122. In addition, a gate terminal is shared between the NMOS transistors 113 and 123. However, it will be apparent to those skilled in the art from having reviewed this description that there are a number of configurations of the PMOS transistors that will allow for current to be mirrored in the reference leg 110 and mirror leg 120 whether the PMOS transistors are enhancement type and/or depletion type.

As recognized to those skilled in the art, the configuration of MOS transistors described above results may result in two stable states during startup, one that results in a reference current, and one that does not. Startup circuit 140 is provided to assure that the MOS transistors assume the state that results in a reference current.

In this stable state, the MOS transistors configured as shown in FIG. 1 facilitate a stable voltage at nodes D and E regardless of fluctuations in the supply voltage at the high voltage source 101. Second, the voltages at nodes D and E are approximately equal. Accordingly, a virtual short may be seen to exist between node D and node E. The remaining elements in the reference leg 110 and mirror leg 120 will now be described.

The reference leg 110 includes a forward region PNP bipolar transistor 114. In this description and in the claims, a "forward region" bipolar transistor is defined as a bipolar transistor that has its emitter-base PN junction forward biased and its collector-base PN junction off during operation. If the bipolar transistor is a PNP bipolar transistor, this may be accomplished by coupling the base terminal to a voltage source (e.g., low voltage source 102) that during operation carries a voltage that is substantially equal to or greater than the voltage applied to its collector terminal. If the bipolar transistor is an NPN bipolar transistor, this may be accomplished by coupling the base terminal to a voltage source (e.g., high voltage source 101) that during operation carries a voltage that is substantially equal to or lower than the voltage applied at its collector terminal. In FIG. 1, this forward region configuration is accomplished by coupling both the base and collector terminals of the PNP bipolar transistor 114 to the low voltage source 102. In this forward region configuration, the voltage between the base terminal and emitter terminal of the bipolar transistor 114 may be expressed by the following equation 1.

$$V_{BE1} = \frac{k \cdot T \cdot nf}{q} \ln\left(\frac{I_{C1}}{I_{S1}}\right) \tag{1}$$

where,

- $V_{BE1}$ is the base emitter voltage across the bipolar transistor 114;
- k is Boltzmann's constant which equals $1.381\times10^{-23}$ joules/Kelvin;
- T is the absolute temperature in degrees Kelvin;
- nf is the forward emission coefficient of the bipolar transistor which is a constant that is usually very close to 1;
- q is the charge magnitude of an electron which equals $1.602\times10^{-19}$ coulombs;
- $I_{C1}$ is the collector current in the bipolar transistor 114; and
- $I_{S1}$ is the saturation current of the bipolar transistor 114.

The mirror leg 120 also includes a forward region PNP bipolar transistor 124. Specifically, the forward region configuration is also accomplished by coupling the base and collector terminals to the low voltage source 102. In this forward region configuration, the voltage between the base terminal and the emitter terminal of the bipolar transistor 124 may be expressed by the following equation 2.

$$V_{BE2} = \frac{k \cdot T \cdot nf}{q} \ln\left(\frac{I_{C2}}{I_{S2}}\right) \tag{2}$$

where, $V_{BE2}$ is the base emitter voltage across the bipolar transistor 124;

$I_{C2}$ is the collector current in the bipolar transistor 124; and $I_{S2}$ is the saturation current of the bipolar transistor 124.

The reference leg 110 also includes a series composite resistor 115 that includes at least two resistors, illustrated as resistor 116 and resistor 117. As is known to those skilled in the art, the sum of voltage changes in a circuit loop should add to zero when starting the loop and ending the loop at the same node. Since node D and node E are virtually shorted together due to node D and node E having an equal voltage, the summing of the loop defined by circular arrow 130 results in the following equation 3.

$$V_{BE2} - \Delta V_{BE} - V_{BE1} = 0 \tag{3}$$

where, $\Delta V_{BE}$ is equal to the voltage applied across the series composite resistor 115.

Solving for $\Delta V_{BE}$ yields equation 4 as follows.

$$\Delta V_{BE} = V_{BE2} - V_{BE1} \tag{4}$$

Substituting $V_{BE1}$ and $V_{BE2}$ from equation 1 and equation 2, respectively, into equation 4 yields the following equation 5.

$$\Delta V_{BE} = \frac{k \cdot T \cdot nf}{q} \left(\ln\left(\frac{I_{C2}}{I_{S2}}\right) - \ln\left(\frac{I_{C1}}{I_{S1}}\right)\right) \tag{5}$$

Equation 5 may be rewritten in equation 6 as follows:

$$\Delta V_{BE} = \frac{k \cdot T \cdot nf}{q} \cdot \ln\left(\frac{I_{C2}}{I_{S2}} \cdot \frac{I_{S1}}{I_{C1}}\right) \tag{6}$$

Since the current in the reference leg 110 is mirrored in the mirror leg 120, the collector currents in the bipolar transistors ($I_{C1}$ and $I_{C2}$) are equal. Accordingly, equation 6 simplifies to equation 7 as follows.

$$\Delta V_{BE} = \frac{k \cdot T \cdot nf}{q} \cdot \ln\left(\frac{I_{S1}}{I_{S2}}\right) \tag{7}$$

The ratio of the emitter area of the bipolar transistor 114 is M times the emitter area of the bipolar transistor 124. Since the saturation current of a bipolar transistor is proportional to the emitter area, equation 7 may be rewritten as equation 8 as follows.

$$\Delta V_{BE} = \frac{k \cdot T \cdot nf}{q} \cdot \ln(M) \tag{8}$$

The equation for the reference current $I_{REF}$ across the series composite resistor 115 is given by equation 9 as follows:

$$I_{REF} = \frac{\Delta V_{BE}}{R_C} \tag{9}$$

where, $R_C$ is the resistance of series composite resistor 115.

Substituting the value of $\Delta V_{BE}$ from equation 8 into equation 9 yields the following equation 10:

$$I_{REF} = \frac{k \cdot nf \cdot \ln(M)}{q} \cdot \frac{T}{R_C} \tag{10}$$

As evident from equation 10, in order to generate a reference current, the emitter area ratio M should be greater than 1. However, the actual emitter area ratio may be in a certain range in order to provide better practical results. A range of 8 to 12 may be used in typical applications. In one implementation, the emitter area ratio is approximately 10.

The temperature coefficient of the reference current $TC(I_{REF})$ is defined by the following equation 11.

$$TC(I_{REF}) = \frac{1}{I_{REF}} \cdot \frac{dI_{REF}}{dT} \tag{11}$$

Substituting the value of $I_{REF}$ from equation 10 into equation 11 and expanding the derivative yields equation 12.

$$TC(I_{REF}) = \frac{\frac{k \cdot nf \cdot \ln(M)}{q}}{\frac{k \cdot nf \cdot \ln(M)}{q} \cdot \frac{T}{R_C}} \cdot \left[\frac{R_C \cdot 1 - T \cdot \delta R_C / \delta T}{R_C \cdot R_C}\right] \tag{12}$$

Equation 12 reduces to the following equation 13.

$$TC(I_{REF}) = \frac{1}{T} - \left(\frac{1}{R_C} \cdot \frac{\delta R_C}{\delta T}\right) \tag{13}$$

The value in the parentheses in equation 13 is the temperature coefficient of the series composite resistor $TC(R_C)$. Accordingly, equation 13 may be rewritten as follows in equation 14.

$$TC(I_{REF}) = \frac{1}{T} - TC(R_C) \tag{14}$$

The temperature coefficient of the reference current $TC(I_{REF})$ should be close to zero in order to provide a reference current $I_{REF}$ that is stable with temperature changes. Accordingly, the selection of resistors 116 and 117 should satisfy the following equation 15.

$$TC(R_C) \cong \frac{1}{T_0} \tag{15}$$

where, $T_0$ is the approximate absolute operating temperature of the resistor 115.

For example, suppose that the operating temperature of the resistor is 300 degrees Kelvin, the temperature coefficient of the series composite resistor 115 should be design to be 3333 ppm/Kelvin.

As mentioned above, the series composite resistor 115 includes at least two resistors 116 and 117. Each of the resistors may be constructed using standard processing steps and without custom doping. At least one of the resistors has a temperature coefficient that is less than the target temperature coefficient of the series composite resistor 115; and at least one of the resistors has a temperature coefficient that is more than the target temperature coefficient of the series composite resistor 115. In a typical CMOS process, the resistors with higher temperature coefficients may be, for example, a well resistor. The resistors with the lower temperature coefficient may be fabricated according to many available processes for fabricating lower temperature coefficient resistors.

The desired temperature coefficient of the series composite resistor may then be obtained by appropriately sizing the resistors 116 and 117 so as to satisfy the following equation 16.

$$TC(R_C) = \frac{R_A \cdot TC(R_A) + R_B \cdot TC(R_B)}{R_A + R_B} \tag{16}$$

where, $R_A$ is the resistance of resistor 116;

$TC(R_A)$ is the temperature coefficient of resistor 116;

$R_B$ is the resistance of resistor 117; and $TC(R_B)$ is the temperature coefficient of resistor 117.

During the design process, resistors 116 and 117 may be selected to satisfy the above criteria. The resistors may even be created using standard processing steps, without the need to customize processes to obtain a desired resistor temperature coefficient. In addition, the resistors are in series, not in parallel. This significantly reduces the amount of space needed to provide a composite resistor having a given resistance and a given temperature coefficient.

Figure 2:
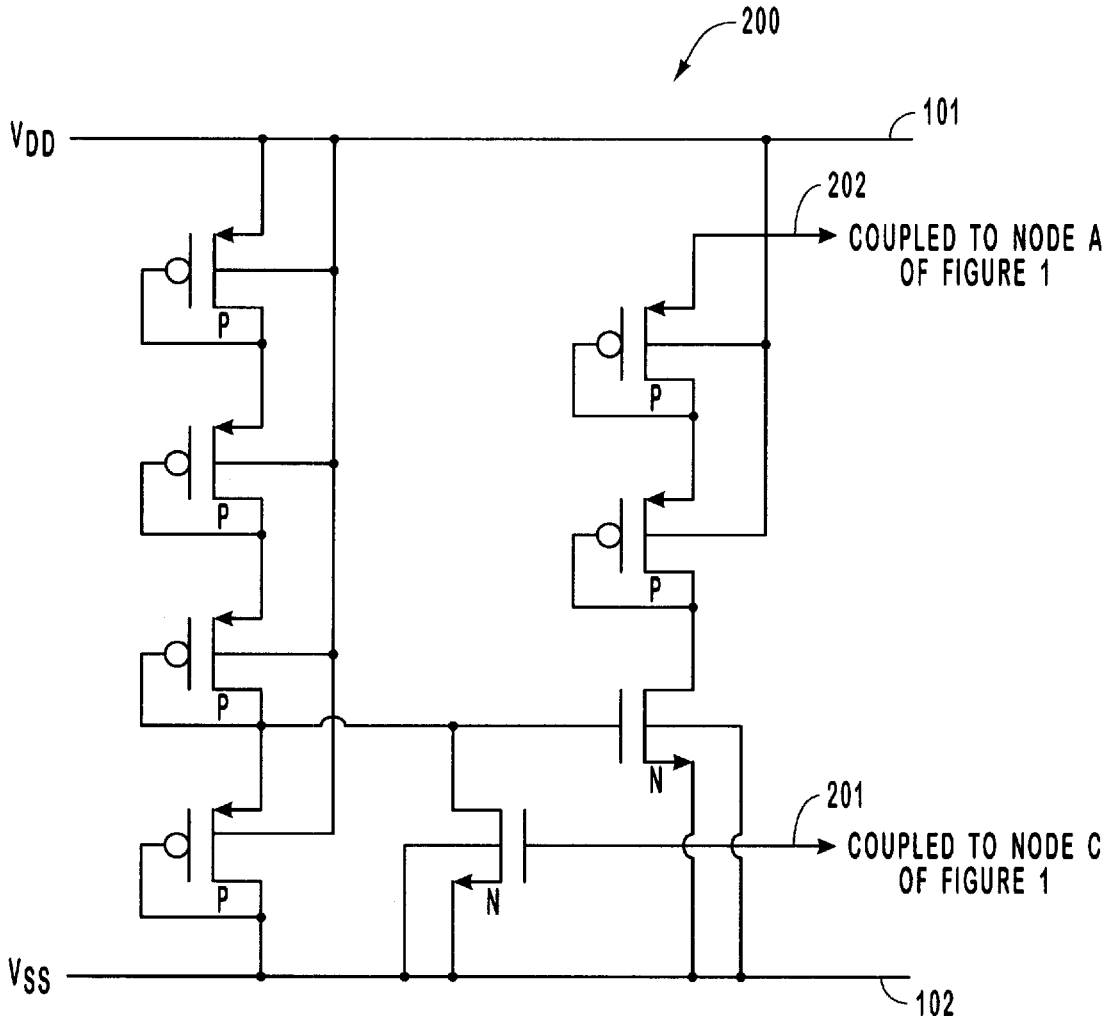
FIG. 2 illustrates a startup circuit that may be used with the current reference circuit of FIG. 1.

FIG. 2 illustrates a startup circuit 200 that may implement startup circuit 140 of FIG. 1. The precise configuration of startup circuit 140 is not critical to the present invention. The startup circuit 200 includes an input line 201 that is coupled to node C of the current reference circuit 100, and an output line 202 that is coupled to node A of the current reference circuit 100.

Having described an embodiment of the present invention, various modifications, deletions, and alternations of this embodiment will be recognized to be within the scope of the present invention. For example, it has already been mentioned that the number of NMOS transistors may be more than one for each leg, and the number of PMOS transistors may be other than two for each leg.

Figure 3:
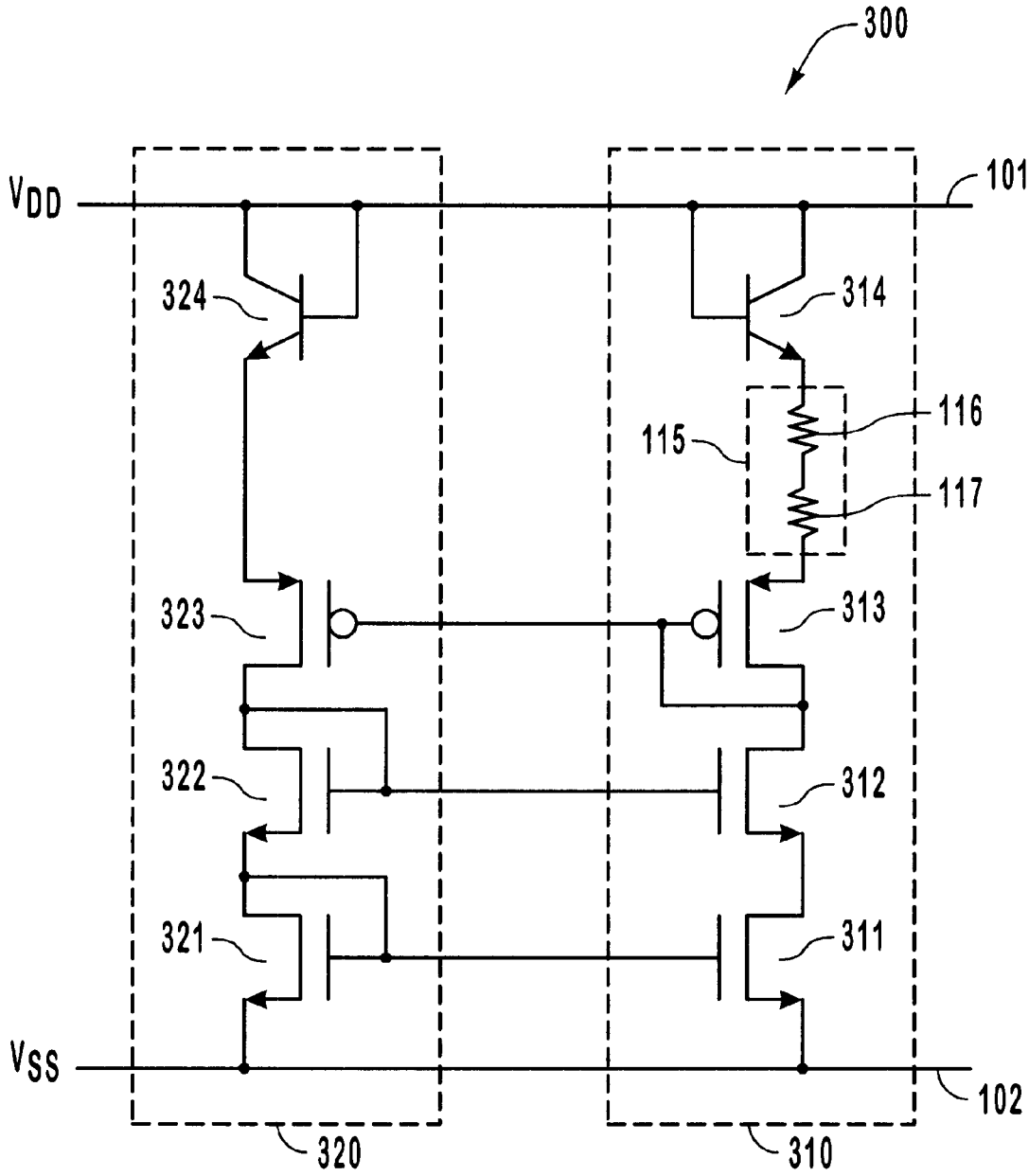
FIG. 3 illustrates an alternative configuration of a current reference circuit that uses a series composite resistor in accordance with the present invention.
Figure 4:
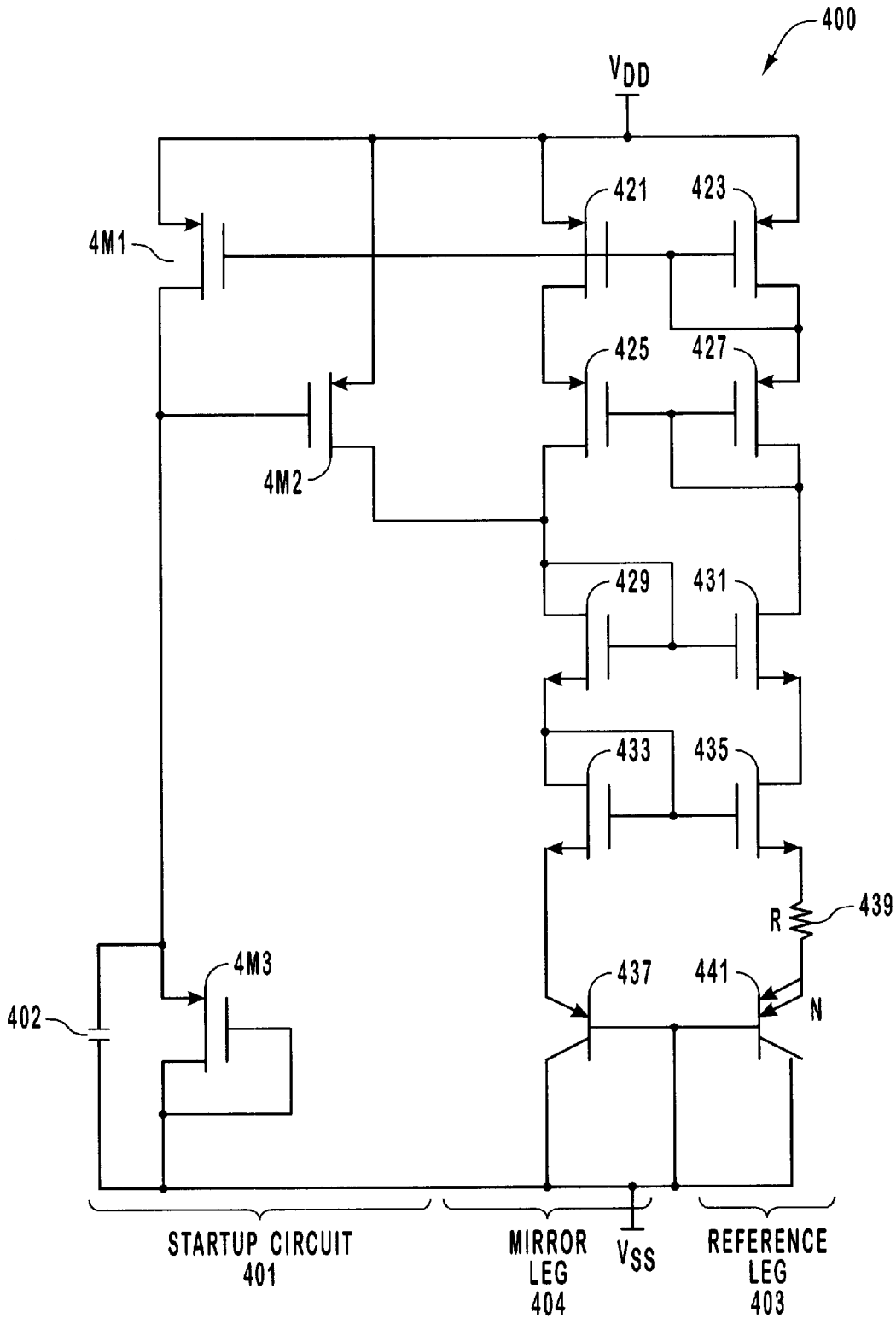
FIG. 4 (PRIOR ART)
FIG. 4 illustrates a current reference circuit that has a custom doped resistor in accordance with the prior art.
Figure 5:
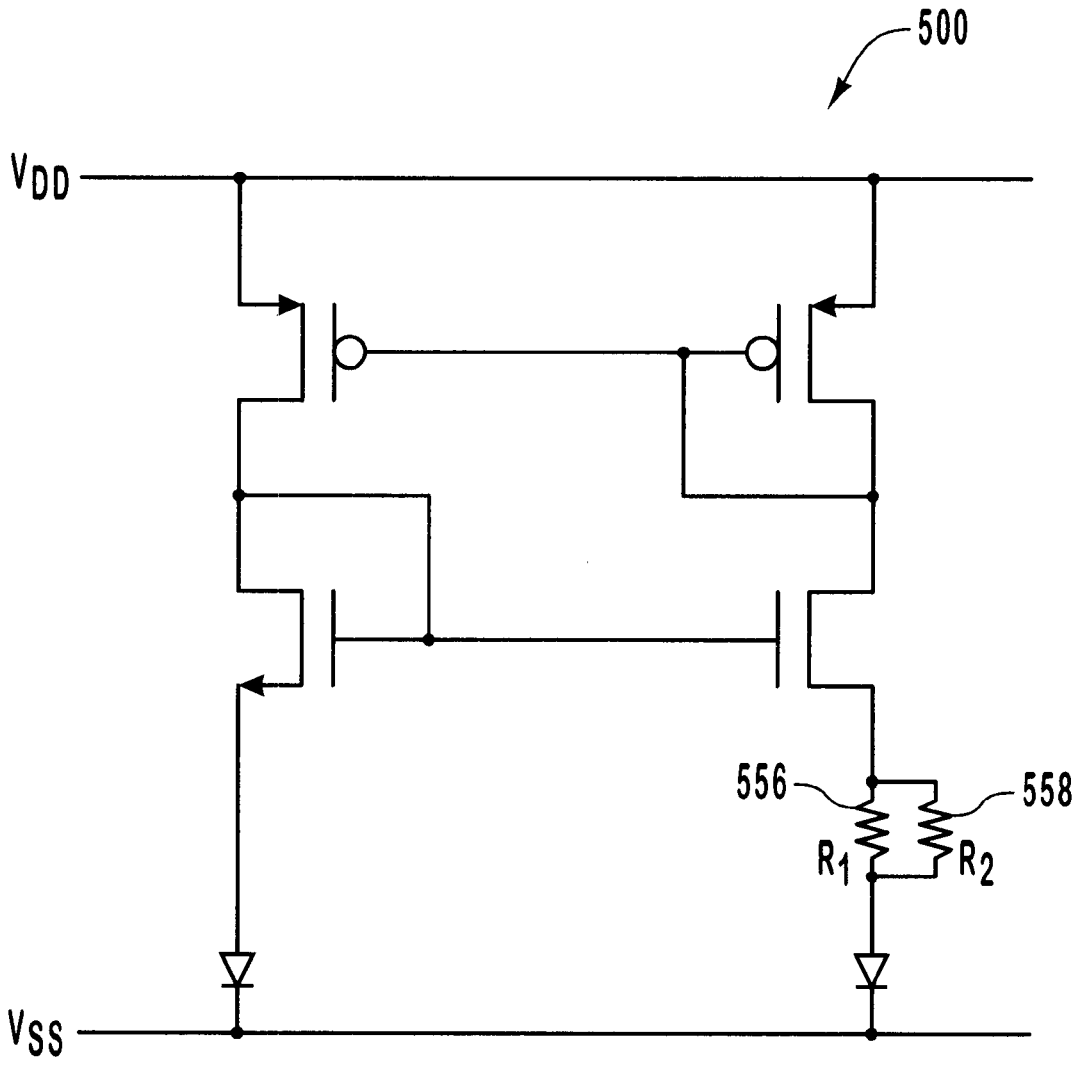
FIG. 5 (PRIOR ART)
FIG. 5 illustrates a current reference circuit that has a parallel composite resistor in accordance with the prior art.

Furthermore, the described bipolar transistors 114 and 124 are PNP type bipolar transistors. However, NPN type bipolar transistors may also be used as illustrated in FIG. 3 in circuit 300. The reference leg 310 of circuit 300 is similar to the reference leg 110 of circuit 100 except that NPN bipolar transistor 314 replaces PNP bipolar transistor 114 with the base and collector terminals of bipolar transistor 314 coupled to high voltage source 101, rather than low voltage source 102. In addition, the two NMOS transistors 311 and 312 are provided electrically closer to the low voltage source 102 instead of the two PMOS transistors 111 and 112 that were provided electrically closer to the high voltage source 101. Also, one PMOS transistor 313 is provided electrically closer to the high voltage source 101 rather than the one NMOS transistor 113 that was provided electrically closer to the low voltage source 102. Furthermore, the series composite resistor 115 is disposed between the NPN bipolar transistor 314 and the PMOS transistor 313.

The mirror leg 320 of circuit 300 is similar to the mirror leg 120 of circuit 100 except that NPN bipolar transistor 324 replaces PNP bipolar transistor 124 with the base and collector terminals of bipolar transistor 324 coupled to high voltage source 101, rather than low voltage source 102. In addition, the two NMOS transistors 321 and 322 are provided electrically closer to the low voltage source 102 instead of the two PMOS transistors 121 and 122 that were provided electrically closer to the high voltage source 101. Also, one PMOS transistor 323 is provided electrically closer to the high voltage source 101 rather than the one NMOS transistor 123 that was provided electrically closer to the low voltage source 102.

The use of PNP type bipolar transistors as shown in FIG. 1 may be desirable, for example, when the fabrication uses a P-type starting material with N-wells. That allows the use of substrate PNP bipolar transistors in which the collector terminal is shorted to the substrate. The use of NPN type bipolar transistors as shown in FIG. 3 may be desirable, for example, when the fabrication uses an N-type starting material with P-wells. That, in turn, allows the use of substrate NPN bipolar transistors in which the collector terminal is shorted to the substrate.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A current reference circuit for providing a current reference that has a controlled temperature coefficient and is relatively stable with supply voltage fluctuations, the current reference circuit having a reference leg and a mirror leg configured such that the current in the reference leg is mirrored in the mirror leg, wherein a resistor in the reference leg may be fabricated using standard processes and occupy minimum space, the current reference circuit comprising the following:

A) a first voltage source, configured to supply a first voltage during operation;

B) a second voltage source, configured to supply a second voltage during operation that is lower than the first voltage;

C) a reference leg coupled between the high voltage source and the low voltage source, the reference leg comprising the following:

i) a plurality of MOS transistors coupled in series between the high voltage source and the low voltage source, the plurality of MOS transistors comprising:

a) a group of at least one PMOS transistor that is electrically closer in the series to the high voltage source; and b) a group of at least one NMOS transistor that is electrically closer in the series to the low voltage source; and ii) a series composite resistor comprising at least a first series resistor and a second series resistor that are coupled in series with each other between the high and low voltage sources, wherein the series composite resistor is disposed on either side of the plurality of MOS transistors in series between the high and low voltage sources, wherein the first series resistor and the second series resistor are fabricated differently; and D) a mirror leg coupled between the high voltage source and the low voltage source, the mirror leg coupled with the reference leg so that current flowing through the reference leg is mirrored in the mirror leg.

2. The current reference circuit in accordance with claim 1, wherein the reference leg further comprises a forward region bipolar transistor coupled in series between the high and low voltage sources, wherein the forward region bipolar transistor is disposed between the composite resistor and one of the high or low voltage sources.

3. The current reference circuit in accordance with claim 2, wherein the forward region bipolar transistor is a first forward region bipolar transistor, the mirror leg comprising:

i) a second forward region bipolar transistor having the same polarity as the first forward region bipolar transistor, wherein the second forward region bipolar transistor is disposed between a second plurality of MOS transistors and one of the high or low voltage sources.

4. The current reference circuit in accordance with claim 3, wherein the emitter area of the first bipolar transistor is larger than the emitter area of the second bipolar transistor.

5. The current reference circuit in accordance with claim 4, wherein the emitter area of the first bipolar transistor is eight to twelve times larger than the emitter area of the second bipolar transistor.

6. The current reference circuit in accordance with claim 5, wherein the emitter area of the first bipolar transistor is approximately ten times larger than the emitter area of the second bipolar transistor.

7. The current reference circuit in accordance with claim 2, wherein the forward region bipolar transistor is a PNP-type bipolar transistor having a base terminal that is shorted to a base terminal voltage source that supplies a base terminal voltage during operation, and having a collector terminal that is shorted to a collector terminal voltage source that supplies a collector terminal voltage during operation, the collector terminal voltage being substantially equal to or less than the base terminal voltage such that the forward region bipolar transistor operates in the forward region.

8. The current reference circuit in accordance with claim 7, wherein the base terminal voltage source is the low voltage source, wherein the PNP-type bipolar transistor is disposed between the composite resistor and the low voltage source.

9. The current reference circuit in accordance with claim 8, wherein the collector terminal voltage supply is also the low voltage source.

10. The current reference circuit in accordance with claim 2, wherein the forward region bipolar transistor is an NPN-type bipolar transistor having a base terminal that is shorted to a base terminal voltage source that supplies a base terminal voltage during operation, and having a collector terminal that is shorted to a collector terminal voltage source that supplies a collector terminal voltage during operation, the collector terminal voltage being substantially equal to or higher than the base terminal voltage such that the forward region bipolar transistor operates in the forward region.

11. The current reference circuit in accordance with claim 10, wherein the base terminal voltage source is the high voltage source, wherein the NPN-type bipolar transistor is disposed between the composite resistor and the high voltage source.

12. The current reference circuit in accordance with claim 11, wherein the collector terminal voltage supply is also the high voltage source.

13. The current reference circuit in accordance with claim 1, wherein the first series resistor has a first temperature coefficient and the second series resistor has a second temperature coefficient that is different than the first temperature coefficient.

14. The current reference circuit in accordance with claim 1, wherein the first series resistor has a first temperature coefficient and the second series resistor has a second temperature coefficient that is different than the first temperature coefficient, wherein the size of the first and second series resistors are such that the temperature coefficient of the composite resistor as a whole adjusts the temperature coefficient of the current reference circuit to a desired value, a zero temperature coefficient or PTAT (proportional to absolute temperature) being two possible values.

15. The current reference circuit in accordance with claim 1, wherein the group of at least one PMOS transistor comprises a first and a second PMOS transistor.

16. The current reference circuit in accordance with claim 1, wherein the group of at least one NMOS transistor is a first NMOS transistor.

17. The current reference circuit in accordance with claim 1, wherein: the plurality of MOS transistors is a first plurality of MOS transistors, the group of at least one PMOS transistor is a first group of at least one PMOS transistor, the group of at least one NMOS transistor is a first group of at least one NMOS transistor, the mirror leg further comprising the following:

i) a second plurality of MOS transistors coupled in series between the high voltage source and the low voltage source, the second plurality of MOS transistors comprising:

a) a second group of at least one PMOS transistor that is electronically closer in the series to the first voltage source, wherein at least one of the PMOS transistors in the second group of at least one PMOS transistor shares a common gate terminal with a PMOS transistor in the first group of at least one PMOS transistor; and b) a second group of at least one NMOS transistor that is electrically closer in the series to the low voltage source, wherein at least one of the NMOS transistors in the second group of at least one NMOS transistor shares a common gate terminal with an NMOS transistor in the first group of at least one NMOS transistor.

18. The current reference circuit in accordance with claim 17, wherein the reference leg further comprises a first forward region bipolar transistor coupled in series between the high and low voltage sources, wherein the first forward region bipolar transistor is disposed between the composite resistor and one of the high or low voltage sources.

19. The current reference circuit in accordance with claim 18, wherein the mirror leg comprises:

i) a second forward region bipolar transistor having the same polarity as the first forward region bipolar transistor, wherein the forward region bipolar transistor is disposed between the second group of MOS transistors and one of the high or low voltage sources.

20. The current reference circuit in accordance with claim 19, wherein the emitter area of the first bipolar transistor is larger than the emitter area of the second bipolar transistor.

21. The current reference circuit in accordance with claim 20, wherein the emitter area of the first bipolar transistor is eight to twelve times larger than the emitter area of the second bipolar transistor.

22. The current reference circuit in accordance with claim 20, wherein the emitter area of the first bipolar transistor is approximately ten times larger than the emitter area of the second bipolar transistor.

23. A current reference circuit for providing a current reference that has a controlled temperature coefficient and is relatively stable with supply voltage fluctuations, the current reference circuit having a reference leg and a mirror leg configured such that the current in the reference leg is mirrored in the mirror leg, wherein a resistor in the reference leg may be fabricated using standard processes and occupy minimal space, the current reference circuit comprising the following:

A) a first voltage source, configured to supply a first voltage during operation;

B) a second voltage source, configured to supply a second voltage during operation that is lower than the first voltage;

C) means for equating a voltage between a node in the reference leg and a corresponding node in the mirror leg;

D) a series composite resistor in the reference leg, the series composite resistor comprising at least a first series resistor and a second series resistor that are coupled in series with each other and between the high and low voltage sources, wherein the series composite resistor is disposed on the side of the node in the reference leg that is closer to a given voltage source, the given voltage source being either the high or low voltage source;

E) a first forward region bipolar transistor in the reference leg coupled in series between the composite resistor and the given voltage source; and F) a second forward region bipolar transistor in the mirror leg coupled in series between the node in the mirror leg and the given voltage source.

24. The current reference circuit in accordance with claim 23, wherein the emitter area of the first forward region bipolar transistor is larger than the emitter area of the second forward region bipolar transistor.

25. The current reference circuit in accordance with claim 24, wherein the emitter area of the first forward region bipolar transistor is eight to twelve times larger than the emitter area of the second forward region bipolar transistor.

26. The current reference circuit in accordance with claim 25, wherein the emitter area of the first forward region bipolar transistor is approximately ten times larger than the emitter area of the second forward region bipolar transistor.

27. The current reference circuit in accordance with claim 23, wherein the first forward region bipolar transistor is a PNP-type bipolar transistor having a base terminal that is shorted to a base terminal voltage source that supplies a base terminal voltage during operation, and having a collector terminal that is shorted to a collector terminal voltage source that supplies a collector terminal voltage during operation, the collector terminal voltage being substantially equal to or less than the base terminal voltage such that the first bipolar transistor operates in the forward region.

28. The current reference circuit in accordance with claim 27, wherein the base terminal voltage source is the low voltage source, wherein the PNP-type bipolar transistor is disposed between the composite resistor and the low voltage source.

29. The current reference circuit in accordance with claim 28, wherein the collector terminal voltage supply is also the low voltage source.

30. The current reference circuit in accordance with claim 23, wherein the first forward region bipolar transistor is an NPN-type bipolar transistor having a base terminal that is shorted to a base terminal voltage source that supplies a base terminal voltage during operation, and having a collector terminal that is shorted to a collector terminal voltage source that supplies a collector terminal voltage during operation, the collector terminal voltage being substantially equal to or higher than the base terminal voltage such that the bipolar transistor operates in the forward region.

31. The current reference circuit in accordance with claim 30, wherein the base terminal voltage source is the high voltage source, wherein the NPN-type bipolar transistor is disposed between the composite resistor and the high voltage source.

32. The current reference circuit in accordance with claim 31, wherein the collector terminal voltage supply is also the high voltage source.

33. The current reference circuit in accordance with claim 23, wherein the first series resistor has a first temperature coefficient and the second series resistor has a second temperature coefficient that is different than the first temperature coefficient.

34. The current reference circuit in accordance with claim 23, wherein the first series resistor has a first temperature coefficient and the second series resistor has a second temperature coefficient that is different than the first temperature coefficient, wherein the size of the first and second series resistors are such that the temperature coefficient of the composite resistor as a whole adjusts the temperature coefficient of the current reference circuit to a desired value, a zero temperature coefficient or PTAT (proportional to absolute temperature) being two possible values.

35. A current reference circuit for providing a current reference that has a controlled temperature coefficient and is relatively stable with supply voltage fluctuations, the current reference circuit having a reference leg and a mirror leg configured such that the current in the reference leg is mirrored in the mirror leg, wherein a resistor in the reference leg may be fabricated using standard processes and occupy minimum space, the current reference circuit comprising the following:

A) a first voltage source, configured to supply a first voltage during operation;

B) a second voltage source, configured to supply a second voltage during operation that is lower than the first voltage;

C) a reference leg coupled between the high voltage source and the low voltage source, the reference leg comprising the following:

i) a first plurality of MOS transistors coupled in series between the first voltage source and the second voltage source, the plurality of MOS transistors comprising:

a) a group of at least one PMOS transistor that is electrically closer in the series to the first voltage source; and b) a group of at least one NMOS transistor that is electrically closer in the series to the second voltage source;

ii) a series composite resistor comprising at least a first series resistor and a second series resistor that are coupled in series with each other between the first and second voltage sources, wherein the series composite resistor is disposed on either side of the first plurality of MOS transistors in series between the high and low voltage sources, wherein the first series resistor and the second series resistor are fabricated differently, wherein the first series resistor has a first temperature coefficient and the second series resistor has a second temperature coefficient that is different than the first temperature coefficient, wherein the size of the first and second series resistors are such that the temperature coefficient of the composite resistor as a whole lowers the temperature coefficient of the current reference circuit as a whole as compared to having just the first or second series resistor; and iii) a first forward region bipolar transistor coupled in series between the first and second voltage sources, wherein the first forward region bipolar transistor is disposed between the series composite resistor and a given voltage source that is one of the high or low voltage sources, wherein the base and collector terminals of the first forward region bipolar transistor are coupled to the given voltage source; and D) a mirror leg coupled between the high voltage source and the low voltage source, the mirror leg coupled with the reference leg so that current flowing through the reference leg is mirrored in the mirror leg, the mirror leg comprising the following:

i) a second plurality of MOS transistors coupled in series between the high voltage source and the low voltage source, the second plurality of MOS transistors comprising:

a) a second group of at least one PMOS transistor that is electrically closer in the series to the high voltage source, wherein at least one of the PMOS transistors in the second group of at least one PMOS transistor shares a common gate terminal with a PMOS transistor in the first group of at least one PMOS transistor; and b) a second group of at least one NMOS transistor that is electrically closer in the series to the low voltage source, wherein at least one of the NMOS transistors in the second group of at least one NMOS transistor shares a common gate terminal with an NMOS transistor in the first group of at least one NMOS transistor; and ii) a second forward region bipolar transistor having the same polarity as the first forward region bipolar transistor, wherein the second forward region bipolar transistor is disposed between the second plurality of MOS transistors and the given voltage source, wherein the emitter area of the first forward region bipolar transistor is larger than the emitter area of the second forward region bipolar transistor.

36. The current reference circuit in accordance with claim 35, wherein the emitter area of the first forward region bipolar transistor is eight to twelve times larger than the emitter area of the second forward region bipolar transistor.

37. The current reference circuit in accordance with claim 36, wherein the emitter area of the first forward region bipolar transistor is approximately ten times larger than the emitter area of the second forward region bipolar transistor.

38. The current reference circuit in accordance with claim 35, wherein the first and second forward region bipolar transistors are each PNP-type bipolar transistors, wherein the given voltage source is the low voltage source.

39. The current reference circuit in accordance with claim 35, wherein the first and second forward region bipolar transistors are each NPN-type bipolar transistors, wherein the given voltage source is the high voltage source.

* * * * *